United States Patent [19]

Teager et al.

[11] 4,218,186

[45] Aug. 19, 1980

[54] INSULATED HUB ARRANGEMENT FOR HIGH TEMPERATURE CENTRIFUGAL FAN

[75] Inventors: Robert S. Teager, Framingham; Richard S. Galvin, Hingham, both of Mass.

[73] Assignee: Westinghouse Electric Corp., Pittsburgh, Pa.

[21] Appl. No.: 954,721

[22] Filed: Oct. 25, 1978

[51] Int. Cl.[2] ..... F04D 29/28; F04D 29/58

[52] U.S. Cl. ..... 416/95; 416/184; 416/224

[58] Field of Search ..... 416/95, 184, 199, 224

[56] References Cited

U.S. PATENT DOCUMENTS

| | | | |
|---|---|---|---|
| 1,090,495 | 3/1914 | Otis | 415/136 |
| 2,287,853 | 6/1942 | Allardice | 416/184 |
| 2,428,728 | 10/1947 | Watson | 416/197 |
| 2,836,348 | 5/1958 | McDonald | 416/95 |

FOREIGN PATENT DOCUMENTS

| | | | |
|---|---|---|---|
| 124163 | 3/1949 | Sweden | 416/184 |
| 2815457 | 10/1978 | United Kingdom | 416/95 |

*Primary Examiner*—Everette A. Powell, Jr.
*Assistant Examiner*—A. N. Trausch, III
*Attorney, Agent, or Firm*—E. C. Arenz

[57] ABSTRACT

An improved heat shield and thermal insulating arrangement for a hub 12 of a high temperature centrifugal fan includes a cover overlying thermal insulation 38, the cover including a circumferential portion comprising segments 42, 44, an end ring 52, and fasteners 54, 58 holding the cover to the hub and a locking collar 28, with the cover basically shielding the root portion 20 of the hub, and being remote from and unattached to the wheel plate 16.

5 Claims, 6 Drawing Figures

INSULATED HUB ARRANGEMENT FOR HIGH TEMPERATURE CENTRIFUGAL FAN

BACKGROUND OF THE INVENTION

1. Field of the Invention:

This invention pertains to the art of thermally insulated hub arrangements for large centrifugal fans of the type used for moving hot gases such as an induced draft fan handling combustion gases in a power plant.

2. Description of the Prior Art:

It has been and is conventional for centrifugal power fans handling high temperature gases in a power plant to have wheel hubs which are shrunk fit on to the rotary shaft driving the wheel. This design has been satisfactory for the majority of applications where the operating conditions are such that the rate of temperature change to which the wheel is exposed is kept within allowable limits. However, with the advent of swing-loaded power plants in the last few years, as well as the increased possibility of upset conditions, power fans are now required to withstand high gas temperature transient conditions much more frequently than in the past. Such thermal transients can cause a high rate of heat influx into the fan's rotor parts and, by nature of the configuration and location of the various rotor components relative to each other and the airstream, the influx of heat can cause a significant temperature differential between the wheel hub and the shaft resulting in a reduction of the interference fit between hub and shaft. If such a reduction is severe enough, the hub may become sufficiently loose on the shaft to result in axial shifting of the wheel along the shaft, or in unstable conditions resulting in rotor vibrations, or in damage to the mating surfaces at the hub-shaft interface, all of which may cause sufficient damage to the fan to require shutdown of the fan and accordingly that part of the power plant.

Solving the problem of a heat shrunk hub coming loose due to temperature transients by a hub insulating arrangement has been recognized in the prior art as in U.S. Pat. No. 2,836,348. That patent discloses an arrangement in which a can-like casing filled with a heat insulating material is placed around a hub, and the rim of the casing is spot welded, according to the patent, to blade supporting bars which are welded to the hubs and which support the blades at the radially outer portion of the bars. We believe the disclosed arrangement would perform satisfactorily with the smaller range of large centrifugal fans, such as those which have a shaft of about 12 inches in diameter more or less. However, the particular arrangement disclosed in that patent is considered to have some deficiencies with respect to an arrangement according to our invention, particularly if the arrangement were to be applied to fans having larger shaft diameters, such as up to, say, 32 inches (0.81 m). Since the disclosed casings are attached solely to the bars at the rims of the casing, the expansion of the bar could lift the casings outwardly so that any clearance opening adjacent the rotary shaft is enlarged with such expansion. Further, the radial dimensions of the casings are such that if the casings were applied to relatively larger diameter shafts, the centrifugal forces created by the rotation could create a problem of unbalance and instability of the casings which would also tend to open up the clearance in the vicinity of the shaft.

Accordingly, it is the aim of our invention to provide an improved heat shielding and thermal insulating arrangement, and to provide one which is applicable to a range of larger size fan wheels, and which is relatively inexpensive and can readily be applied either during the original manufacture of the wheel or as a field fix.

SUMMARY OF THE INVENTION

In accordance with the invention, the improved heat shielding and insulating arrangement is provided for that type of hub which is a one-piece member which has an axially extending root portion heat shrunk onto a rotary shaft and which turns up at its inner end and terminates in a radially extending flange lying in a plane normal to the axis of the shaft, that flange having the radially inner portion of a wheel plate secured by fasteners to it. The arrangement includes a collar encircling and secured to the shaft at the outer end of the root portion, thermal insulation encompassing the root portion of the hub, and a cover of generally elongated, can-shaped form around the insulation and extending to the outer side of the collar, this cover comprising both a circumferential portion and an outer end portion. The circumferential portion comprises at least a pair of circumferentially extending segments, each of which includes means along its opposite axially extending edges for fastening to an edge of an adjacent segment, and the outer end portion of the cover has a central opening sized to accommodate the shaft in relatively closely fitting relation to substantially minimize leakage of hot gas handled by the fan into the space in the cover adjacent the collar. Preferably the collar is provided with a larger circumference than the root portion at the outer end of the root so that with the outer end margins of the circumferential portion seating on the circumference of the collar an annular space is defined between the root exterior surface and the circumferential portion to accommodate the thermal insulation therein. The cover terminates at its open inner end short of the flange and is secured only to the hub and collar. There is no attachment between the cover and the wheel plate so that any expansion of the wheel plate is not directly transmitted to the cover.

DRAWING DESCRIPTION

DESCRIPTION OF THE PREFERRED EMBODIMENTS

Figure 1:
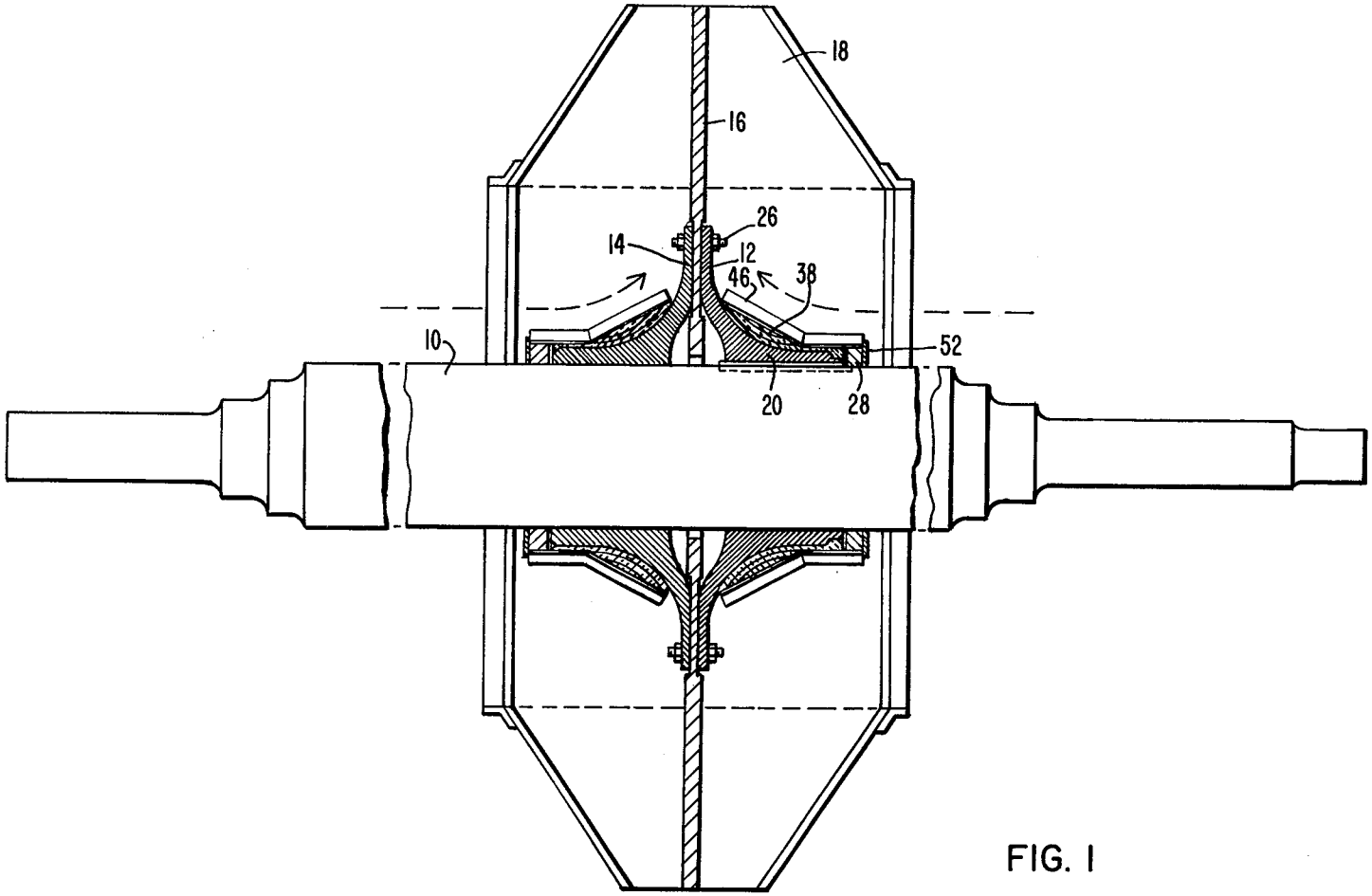
FIG. 1 is a partly broken view of a double width, double inlet centrifugal fan of one type to which one form of the invention is applied.
Figure 2:
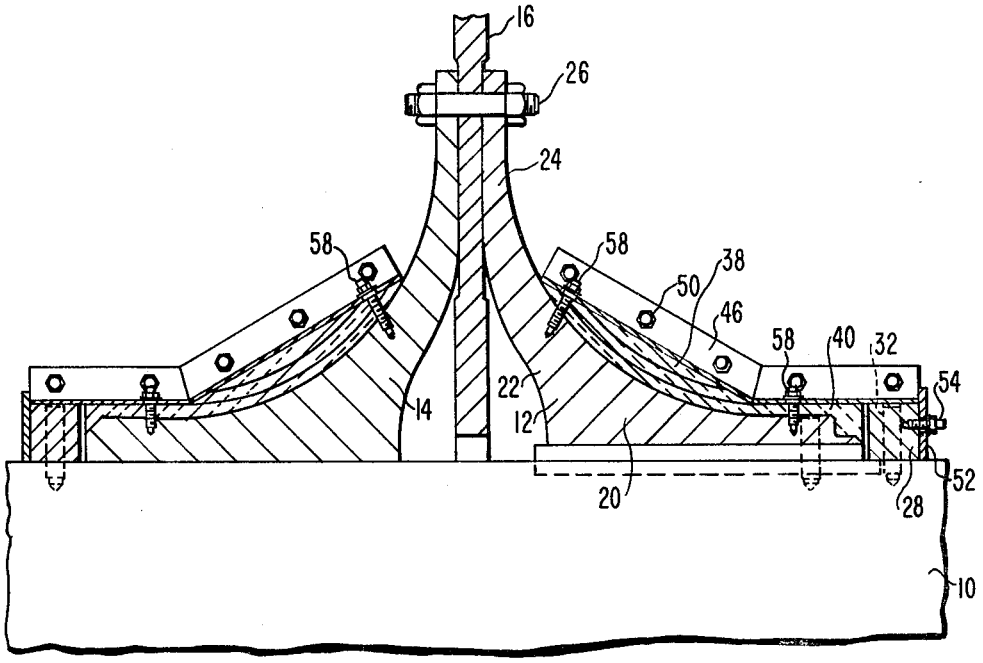
FIG. 2 is a fragmentary view, enlarged relative to FIG. 1, illustrating the one form of the invention in somewhat more detail.

Referring to FIGS. 1 and 2, the centrifugal fan wheel includes a rotary shaft 10 which has two opposing hubs 12 and 14 heat shrunk onto the shaft. The hubs support a disc-shaped wheel plate 16 having fan blades 18 secured thereto at its outer peripheral portion. While the fan wheel illustrated in FIG. 1 is of the double width, double inlet type in which air sweeps in from both directions as indicated by the dash line arrows in FIG. 1, the invention would also be applicable to a single width, single inlet type fan in which only one of the hubs 12 or 14 would be present and the centerplate 16 would be the backplate. Since the hubs 12 and 14 are of the same basic shape, only that one designated 12 will be described in any detail. Both hubs are a one-piece member which includes an axially extending root portion 20 which turns up at its inner end to form the portion 22, which portion in turn terminates in a radially extending flange 24 which lies in a plane normal to the axis of the shaft 10. The radially inner portion of the wheel plate 16 is secured to the flanges of the two hubs by fasteners 26.

Figure 6:
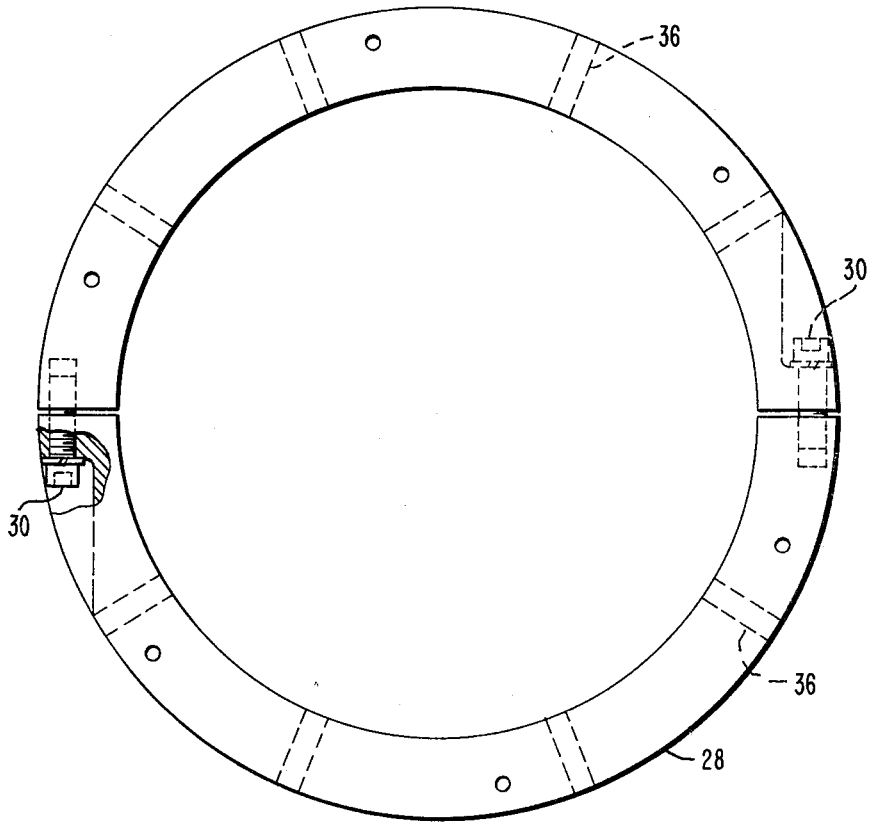
FIG. 6 is an elevation view of one form of collar which may be used in accordance with the invention.

In the preferred arrangement, a locking collar 28 (FIGS. 2 and 6) is provided at the outer end of each of the hub roots. As shown in FIG. 6, the locking collar is conveniently made as a two-piece split ring which is applied to encircle the shaft and is then tightened down thereagainst by the bolts 30 adjacent the splits. The collar is further secured to the shaft by a series of fasteners such as dowels 32 which are received and extend radially inwardly through the holes 34 (FIG. 6) at circumferentially spaced locations around the collar.

Thermal insulation 38, such as Johns Manville Cerablanket, is applied and bonded in one or more layers to encompass at least the root portion 20 of the hub. In the form of hub shown in FIG. 2, in which the root portion generally merges into the turned-up portion 22 of the hub, a single layer of the thermal insulation 40 may be applied around the outer end portion of the hub, while several layers are applied in the location adjacent the turned-up portion of the hub.

Figure 5:
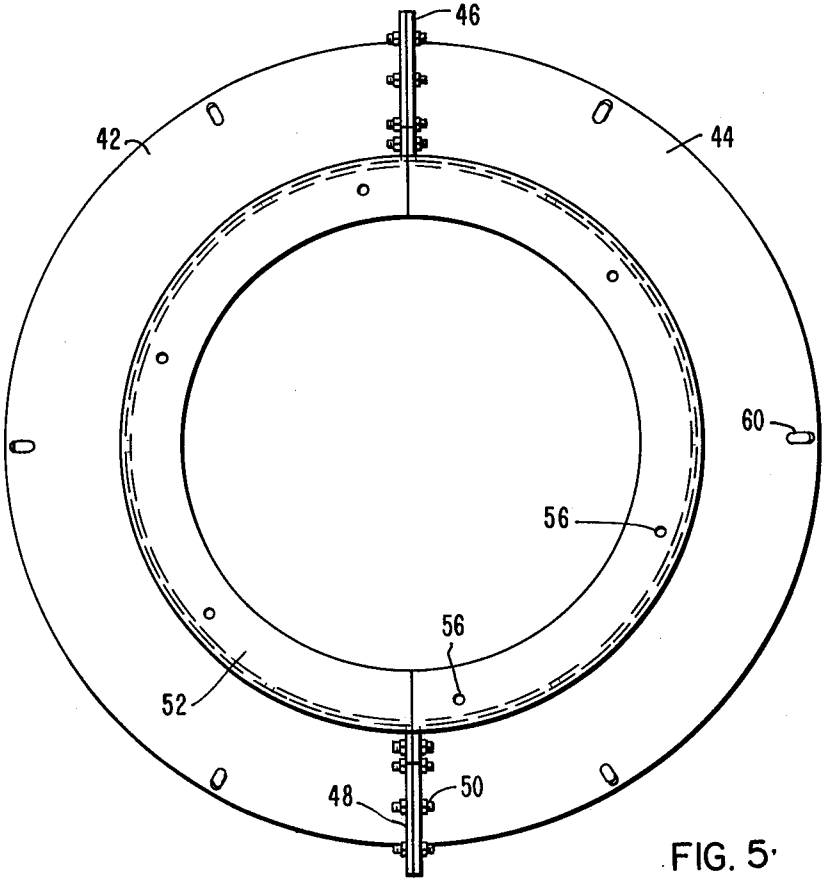
FIG. 5 is an end view of the cover of FIG. 4.
Figure 4:
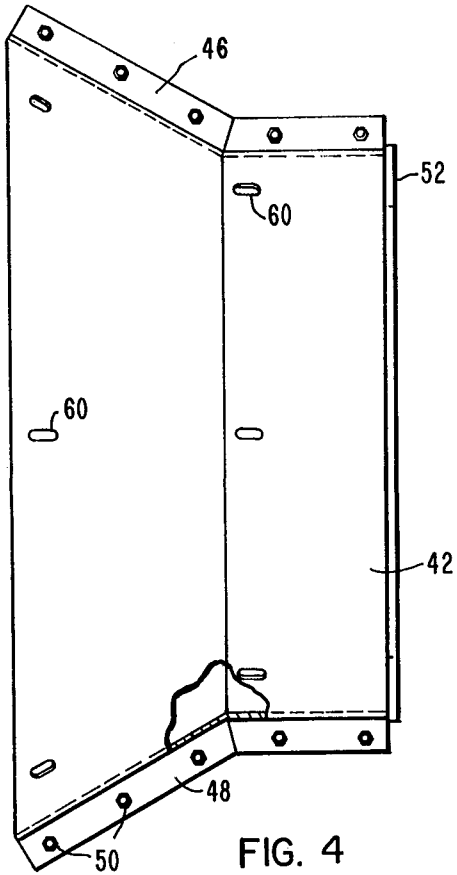
FIG. 4 is a side view of the cover of FIG. 2.

Referring now to FIGS. 2, 4 and 5, the arrangement includes a cover which can be considered to be of generally elongated, can-shaped form to fit around the insulation and at the outer side of the collar 28. The cover includes a circumferential portion which surrounds the insulation and an outer end portion. The circumferential portion comprises at least a pair of circumferentially extending segments 42 and 44 (FIG. 5), each of which includes means along its opposite axially extending edges for fastening to an edge of an adjacent segment. In the particular configuration illustrated, there are only the two circumferentially extending segments, and each includes outwardly projecting flanges 46 and 48 which abut and are secured together by the fasteners 50. The outer end portion of the cover takes the form of a ring-shaped disc 52 provided with a central opening to accommodate the shaft 10 in relatively closely fitting relation. The ring 52 is fastened to the collar by a series of studs 54 which extend through the openings 56 (FIG. 5) spaced circumferentially around the ring. Additionally, it is considered desirable that the outer end edge of the circumferential portion of the cover be welded to the inner face of the ring 52 where they abut.

The circumferential portion of the cover is secured to the hub at various locations by drilling and tapping holes in the hub and then applying fasteners 58 which may take the form of studs and nuts for example. The fasteners are applied through slotted holes 60 (FIGS. 4 and 5) located in spaced apart relation on the circumferential portion of the cover.

The circumferential portion of the cover shown in FIG. 2 has the shape shown, comprising an open-ended cone connected to a right cylinder, for purposes of manufacturing economy. It will be appreciated that the particular configuration of the cover could be otherwise such as the cone-shaped part being broken into several smaller cones to more closely follow the contour of the hub. However, it will be observed that even with the two-piece structure of the circumferential portion of the cover, the cover configuration does generally follow the contour of the exterior surface of the hub to the turned-up portion 22. The particular shape also permits the use of multiple layers of thermal insulation in the space encompassed by the conical part of the cover. This may be beneficial in that as the hot gases flow axially inwardly and then turns to flow radially outwardly, there is a tendency to more rapidly transfer heat to any surface upon which the gas impinges.

The arrangement illustrated in FIG. 2 is one which has proven to be satisfactory in connection with a centrifugal fan having a 27 inch (0.68 m) diameter shaft. The layer 40 of insulation was only ¾ inch (0.02 m) thick.

Figure 3:
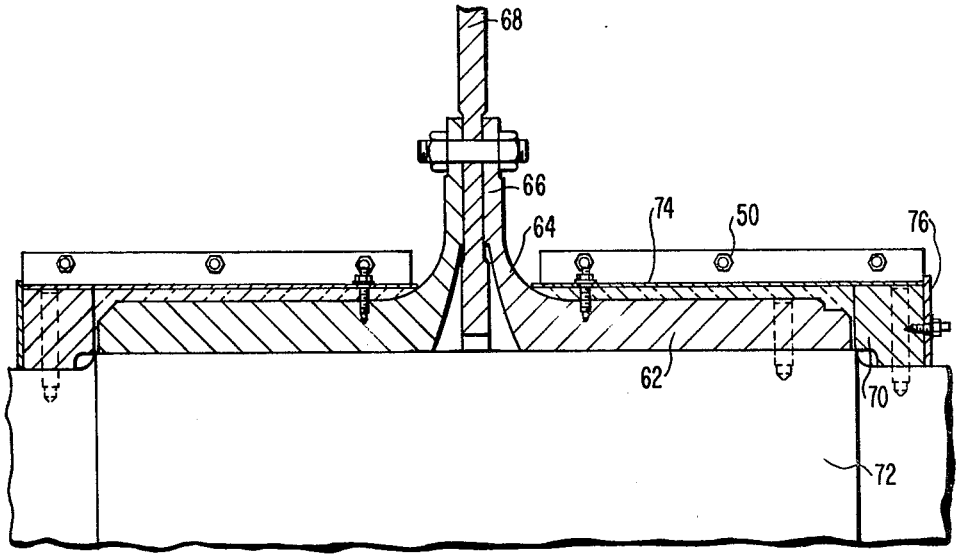
FIG. 3 is a fragmentary view similar to FIG. 2 showing another form of the invention applied to a hub arrangement of different configuration from that of FIG. 2.

The arrangement shown in FIG. 3 is one which has been applied to a particular centrifugal fan having a slightly differently configured hub and cover arrangement. In this case the exterior surface of the root 62 of the hub is parallel with the shaft axis throughout most of the axial extent of the root. However, the hub turns up at 64 to terminate in the flange 66 to which the wheel plate 68 is attached. The collar 70 has a slightly different formation since in the particular fan the shaft 72 is of slightly reduced diameter at the location of the collar.

The circumferential portion 74 of the cover in FIG. 3 is comprised of at least a pair of segments which, when assembled, form a right cylinder. The end ring 76 of the cover is basically as in the arrangement of FIG. 2.

It is to be appreciated that the basic approach of the covers is the same irrespective of slight variations in the particular configuration of the hubs to which the arrangement is being applied. In all cases it will be seen that the application of the insulation is to the root portion of the hub primarily and that the cover is tied tightly to the root and collar. There is no direct attachment to the wheel plate or to the flanges which tend to heat up first in a high temperature environment. In other words the cover is tied down tightly and by tying the end rings into the collar it is ensured that they will not lift away to permit the entry of hot gases into the outer end space under the cover.

The arrangement according to the invention is adapted to be used either in a field fix, or to be applied during the initial manufacture of the fan. It is reasonably inexpensive and has been found to solve serious problems occurring with large fans in the field such as those having a 32 inch (0.81 m) diameter shaft and which correspond to the arrangement shown in FIG. 3.

What is claimed is:

1. In a centrifugal fan of the type having a thermally insulated hub, an improved heat shielding and insulating arrangement for that type of hub which is a one-piece member having an axially extending root portion which is heat shrunk on onto a rotary shaft and turns up at its inner end and terminates in a radially extending flange lying in a plane normal to the axis of the shaft, and which has the radially inner portion of a wheel plate secured by fasteners to the flange, comprising:

a collar encircling and secured to said shaft at the outer end of said root portion;

a heat shield including a circumferential portion having a shape generally following the contour of said root portion in sufficiently spaced apart relation with the outer surface of said root portion to form an annular space therebetween to accommodate a depth of thermal insulation determined in accordance with the temperature variation design conditions for the fan, said circumferential portion comprising at least a pair of circumferentially extending segments, each of which includes means along its opposite axially extending edges for fastening to the adjacent segment;

thermal insulation in said annular space;

means fastening said circumferential segments to said root portion;

an end disc for said shield having a central opening to accommodate said shaft in relatively close fitting relation to substantially minimize leakage of hot gases handled by said fan into the space in said cover adjacent said collar;

means securing said end disc in fixed relation to said collar and said circumferential portion; and said circumferential portion being unattached to said wheel plate so that movement of said plate in accordance with temperature changes thereof is not directly translated to said circumferential portion.

2. An arrangement according to claim 1 wherein:

said circumferential portion comprises one pair of said segments, each extending through about 180° C., and each segment includes outwardly directed flange means at the axially extending edges for accommodating fastening.

3. An arrangement according to claim 1 wherein:

said collar projects radially outwardly beyond the radially outer surface of the end portion of said hub root portion to a degree corresponding to the depth of insulation desired at said outer end portion.

4. An arrangement according to claim 1 wherein:

said fan includes a pair of hubs of generally mirror image form and relation on said shaft;

said wheel plate is sandwiched between said flanges; and a heat shielding and insulating arrangement is provided for each hub.

5. In a centrifugal fan of the type having a thermally insulated hub, an improved heat shielding and insulating arrangement for that type of hub which is a one-piece member having an axially extending root portion which is heat shrunk onto a rotary shaft and turns up at its inner end and terminates in a radially extending flange lying in a plane normal to the axis of the shaft, and which has the radially inner portion of a wheel plate secured by fasteners to the flange, comprising:

a collar encircling and secured to said shaft at the outer end of said root portion;

thermal insulation encompassing the root portion of said hub;

a cover of generally elongated, can-shaped form around said insulation and at the outer side of said collar, and comprising a circumferential portion and an outer end portion;

said circumferential portion comprising at least a pair of circumferentially extending segments, each of which includes means along its opposite axially extending edges for fastening to an edge of an adjacent segment;

said collar having a larger circumference than said root portion at said outer end so that with the outer end margin of said circumferential portion seating on the circumference of said collar an annular space is defined between the root exterior and said circumferential portion to accommodate said thermal insulation therein;

means fastening said circumferential portion to said root portion;

said outer end portion of said cover having a central opening to accommodate said shaft in relatively closely fitting relation to substantially minimize leakage of hot gas handled by said fan into the space in said cover adjacent said collar;

means securing said outer end portion of said cover in place; and said cover being unsecured to said wheel plate and terminating at its inner open end generally at said turned-up portion of said hub.

* * * * *